US006640782B2

(12) United States Patent
Boecking

(10) Patent No.: US 6,640,782 B2
(45) Date of Patent: Nov. 4, 2003

(54) FUEL-INJECTION APPARATUS FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/070,371

(22) PCT Filed: Jun. 13, 2001

(86) PCT No.: PCT/EP01/06692

§ 371 (c)(1),
(2), (4) Date: Jun. 12, 2002

(87) PCT Pub. No.: WO02/02926

PCT Pub. Date: Jan. 10, 2002

(65) Prior Publication Data

US 2002/0162899 A1 Nov. 7, 2002

(30) Foreign Application Priority Data

Jul. 6, 2000 (DE) ..... 100 32 923

(51) Int. Cl.[7] ..... F02M 37/04
(52) U.S. Cl. ..... 123/456; 123/458; 251/129.07
(58) Field of Search ..... 123/458, 457, 123/460, 498, 446, 456; 251/129.07, 282, 129.06

(56) References Cited

U.S. PATENT DOCUMENTS

| | | | |
|---|---|---|---|
| 4,653,723 A | 3/1987 | Rizk et al. | 251/282 |
| 5,239,968 A | 8/1993 | Rodriguez-Amaya et al. | 123/506 |
| 5,941,215 A | 8/1999 | Augustin | 123/467 |
| 6,067,955 A | 5/2000 | Boecking | 123/299 |
| 6,067,964 A | 5/2000 | Ruoff et al. | 123/467 |

FOREIGN PATENT DOCUMENTS

| | | |
|---|---|---|
| DE | 19803910 | 11/1998 |
| DE | 19837333 | 2/2000 |

*Primary Examiner*—Carl S. Miller
(74) *Attorney, Agent, or Firm*—Ronald E. Greigg

(57) ABSTRACT

A fuel injection apparatus for internal combustion engines conveys fuel from a high-pressure fuel reservoir to an injection opening by means of a control valve, which can be actuated by a piezoelectric unit. The control valve has a valve member, which can be moved axially between a first valve seat and a second valve seat, which define a first valve chamber. A line leading from the high-pressure fuel source feeds into a second valve chamber, which is defined by the first valve seat and a first guide of the valve member in the valve body. A line, which leads to the injection opening, branches from the first valve chamber. A second guide of the valve member is provided in a region of the valve member adjacent to the second valve seat. On the respective side of each guide, a respective leakage line is provided. The diameters of the valve seats and the guides are respectively selected to be the same so that a force compensation is achieved in the control valve.

21 Claims, 1 Drawing Sheet

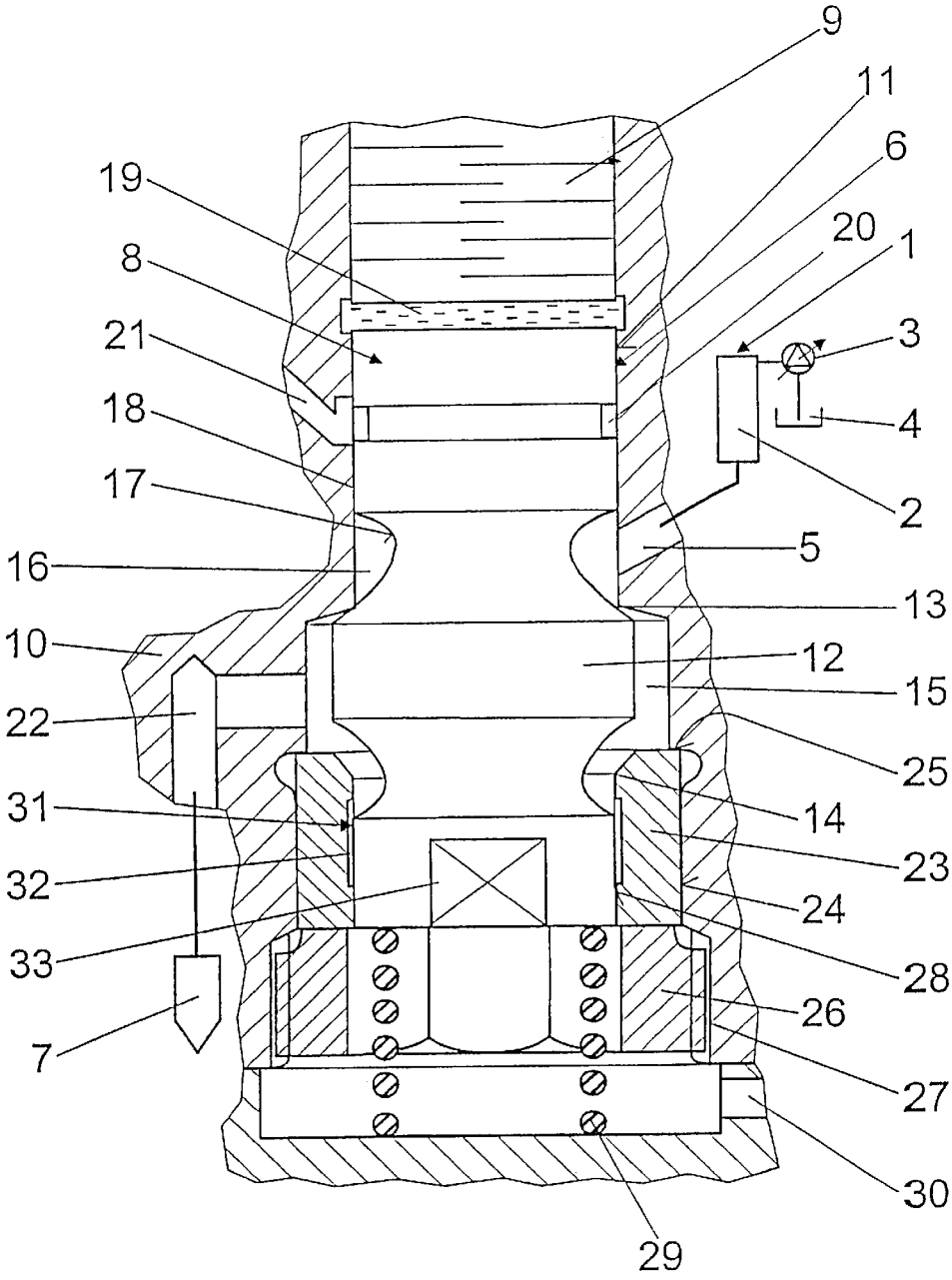
9
11
6
19
20
1
8
3
21
4
18
2
17
5
16
13
10
12
15
22
25
31
14
23
32
24
33
28
26
7
27
30
29

FUEL-INJECTION APPARATUS FOR INTERNAL COMBUSTION ENGINES

CROSS-REFERENCE TO RELATED APPLICATIONS

This application is a 35 U.S.C. 371 application of PCT/EP 01/06692, filed on Jun. 13, 2001.

BACKGROUND OF THE INVENTION

1. Field of the Invention

The invention relates to a fuel injection apparatus for internal combustion engines in which fuel is conveyed from a high-pressure fuel source to an injection opening via a control valve.

2. Description of the Prior Art

In fuel injection apparatuses of the kind referred to above, which are extensively known from the prior art and are particularly used in common rail systems, the supply of fuel to the injection opening, which is usually embodied as a nozzle holder device, is frequently controlled by means of a slide valve or seat/slide valve, which can be embodied as force-compensated or partially force-compensated. The use of slide valves, which have control edges for covering and uncovering inlets and outlets, however, is disadvantageous due to the large leakages, which result from the usually small overlap.

One way to avoid these disadvantages is to use a double seat valve, which has the advantage over slide valves that the stroke length is considerably increased and in which a high degree of sealing action at the seats can be achieved. In trials, it has also been demonstrated that the stroke length in a double seat valve can be selected to be small so that the valve can be directly controlled by a piezoelectric unit while complying with the requirement for a force-compensated valve.

DE 198 60 678 has disclosed a fuel injection apparatus for internal combustion engines of this kind in which a fuel injection valve is supplied with fuel by means of a pressure line. For controlling an injection opening, this known fuel injection apparatus has an injection valve member whose movement—and therefore the opening of the injection nozzle—is controlled by a control valve, which has a control valve member that is actuated by the piezoelectric actuator. This control valve member is embodied with a valve head and cooperates with two valve seats of the control valve in such a way that when electrical voltage is applied to the piezoelectric actuator, this permits a flow of fuel, which is conveyed from the high-pressure fuel source by means of a line, via the first valve seat and the second valve seat, and into a line leading to the injection opening.

However, the complex embodiment of the valve housing with a number of mold joints has proven to be problematic, where it turns out to be particularly difficult to assemble a force-compensated valve with a multi-part valve body.

SUMMARY OF THE INVENTION

The fuel injection apparatus according to the invention has the advantage that the control valve is provided as a precisely functioning 3/2-way valve in a pressure-controlled system, which valve can be directly actuated by a piezoelectric unit by means of a mechanical transmission and in a particularly advantageous manner, by means of a hydraulic transmission. The integration of the control valve into the inlet of fuel into the injection opening of the fuel injection apparatus permits short injections that can be precisely metered.

A significant advantage of the fuel injection apparatus according to the invention lies in the design of the control valve, which permits the realization of the valve with essentially one valve body into which a component that is suitable for embodying the second valve seat and the second guide can be inserted, preferably a sleeve.

Embodied in a correspondingly simple manner, the assembly of the control valve, particularly the valve body and the opposing piece that constitutes the second valve seat can be advantageously produced in one chucking operation. This achieves a high degree of precision fit of the components with one another.

BRIEF DESCRIPTION OF THE DRAWINGS

An exemplary embodiment of the invention is described herein below, with reference to the sole drawing FIGURE which schematically depicts a fuel injection apparatus according to the invention, which is supplied with fuel from a high-pressure fuel reservoir, particularly showing the design of a control valve of the fuel injection apparatus.

DESCRIPTION OF THE PREFERRED EMBODIMENTS

The exemplary embodiment shown in the figure is a fuel injection apparatus for internal combustion engines of motor vehicles, which is embodied as a common rail injector for injecting diesel fuel. The common rail system represents a high-pressure fuel source 1, which is embodied with a high-pressure fuel reservoir 2, which a high-pressure fuel-supply pump 3 supplies with fuel from a fuel tank 4 and which has been compressed to an injection pressure.

A line 5 leads from the high-pressure fuel reservoir 2 to a control valve 6, which in turn conveys the fuel to an injection opening 7 for injection; this injection opening is only symbolically indicated in the FIGURE and can be conventionally embodied as a nozzle holder device.

In order to adjust an injection onset, an injection duration, and a fuel injection quantity by means of the fuel supply, the control valve 6 is embodied with a valve member 8, which is controlled by means of a piezoelectric unit embodied as a piezoelectric actuator 9.

The valve member 8 is embodied in the form of a tappet and is disposed so that it can move in a longitudinal bore 11 of a valve body 10; in a central region, it has a cross sectionally widened valve head 12, which has a plate-like valve head sealing surface in both movement directions, which it uses to cooperate with a first valve seat 13, which is on the same side as the piezoelectric actuator, and an opposing second valve seat 14 in a first valve chamber 15.

As shown in the FIGURE, the line 5 leading from the high-pressure fuel source 1 feeds into a second valve chamber 16, which adjoins the first valve seat 13 and is formed by the longitudinal bore 11 and an annular groove-like recess 17 of the valve member 8 when the valve member 8 contacts the first valve seat 13. This second valve chamber 16 is adjoined on the piezoelectric actuator side by a first guide 18 of the valve member 8 in the valve body 10, which guide has the same diameter as the first valve seat 13.

With its end oriented toward the piezoelectric actuator 9, the valve member 8 is inserted into a hydraulic chamber 19, which functions as a hydraulic transmission that transmits length changes of the piezoelectric actuator 9 to the valve member 8 and also serves as a compensation element for temperature-induced expansion fluctuations of the components around it.

In a region between the first guide 18, which is oriented toward the piezoelectric unit 9, and the hydraulic chamber 19, an annular chamber 20 is provided around the valve member 8 and a leakage line 21 leads from this annular chamber 20.

It is clear from inspecting the arrangement of the fuel injection apparatus according to the invention, on the side of the second valve seat 14 remote from the piezoelectric actuator 9, that the first valve chamber 15, from which a line 22 leads in order to convey fuel to the injection opening 7, is bounded by a sleeve 23 onto which the second valve seat 14 is formed. The sleeve 23 is slid into a receptacle 24, which is produced or ground during the manufacture of the valve body 10, preferably in one chucking operation with the first guide 18 and the first valve seat 13, in order to achieve an optimal true running and a high consistency. In the receptacle 24, the sleeve 23 is secured on its side oriented away from the first valve chamber 15 by an adjusting nut, as a result of which the sleeve 23 is pressed against a sealing edge 25 with its end oriented toward the first valve chamber 15.

As with the valve body 10, which is embodied of one piece, from a receptacle for the piezoelectric actuator 9 to a thread 27 for the screwing-on of the nut 26, the sleeve 23 is formed in one tool chucking operation.

On an inner diameter of the sleeve 23, in a region adjoining the second valve seat 14, a second guide 28 is provided, which has the same diameter as the second valve seat 14 and the first guide 18.

On the side of the guide 28 remote from the first valve chamber 15, the valve member 8 is installed prestressed with a spring 29 in such a way that when in the non-actuated state, in which the piezoelectric actuator 9 is not supplied with electrical current, the valve member 8 is pressed against the first valve seat 13. Also at this end of the valve member 8, a leakage line 30 is provided, which is connected to the first valve chamber 15 by means of a line 31. The line 31 here is a gap space around the valve member 8, which is constituted by an inner annular groove 32 in the sleeve 23 and a bevel 33 on the valve member 8 that connects this annular groove 32 to the end of the valve member 8.

Through the selection of the same diameter for the first guide 18 and the second valve seat 13, the control valve 6, which represents a 3/2-way valve, is force-compensated in the closed state, i.e. when in contact with the first valve seat 13. Since the second valve seat 14 and the second guide 28 also have the same diameter as the first valve seat 13 and the first guide 18, the control valve 6 is also force-compensated in the open state in which fuel flows via the line 22 to the nozzle opening 7, i.e. no hydraulic force causes the valve member 8 to slide.

In order not to overstrain the system, in the current embodiment, the second guide 28 is embodied with a play that is greater than the play of the first guide by a factor of 2 to 3. Naturally in other embodiments, a different play can also be provided, which is, for example, greater than the play of the first guide 18 by a factor of 2 to 5, where the first guide 18 can have a play of preferably 1 to 4 $\mu$m and the second guide 28 can have a play of 4 to 10 $\mu$m.

The fuel injection apparatus according to the FIGURE in the drawing functions in the manner described below.

When the injection opening 7 is closed, i.e. when the piezoelectric actuator 9 is not supplied with current, the valve member 8 rests with the valve head 12 against the first valve seat 13 and is acted on with an initial spring tension by the spring 29. Above the first valve seat 13, high pressure from the common rail system 1 prevails in the second valve chamber 16.

In order to open the injection opening 7, voltage is applied to the piezoelectric actuator 9, which causes it to suddenly expand axially. Such a rapid actuation of the piezoelectric actuator 9 produces an opening pressure in the hydraulic chamber 19, which is transmitted to the valve member 8.

Since the control valve 6 is embodied as force-compensated, the piezoelectric actuator 9 need only overcome the spring force of the spring 29 in order to slide the valve member 8 into an open position. If the opening pressure produced by the piezoelectric actuator 9 is transmitted to the valve member 8 by means of the hydraulic chamber 19 or an alternative mechanical transmission device, and the valve member 8 is lifted up from the first valve seat 13, then the highly pressurized fuel flows out of the supply line 5, via the open first valve seat 13 and the first valve chamber 15, into the line 22, which leads to the injection opening 7. In this open state of the control valve 6, the valve member 8 comes to rest with the valve head 12 against the second valve seat 14, which produces a reliable seal in the open state.

In order to close the injection opening 7, the supply of current to the piezoelectric actuator 9 is interrupted, which causes it to shorten axially which reduces the pressure in the hydraulic chamber 19. As a result, the valve member 8 is moved back toward the first valve seat 13 by the spring 29, which interrupts the sealing action at the inner valve seat 14. During the closing process, leakage oil is conveyed via the line 31, which is comprised of the annular groove 32 and the bevel 33 on the valve member 8, to the leakage line 30, as a result of which the system is relieved of pressure during the closing of the control valve 6.

In summary, the invention produces a force-compensated 3/2-way control valve 6 for a pressure-controlled common rail injector system, which is easy to install and permits high-precision injections.

The foregoing relates to preferred exemplary embodiments of the invention, it being understood that other variants and embodiments are possible within the spirit and scope of the invention, the latter being defined by the appended claims.

What is claimed is:

1. A fuel injection apparatus (1) for internal combustion engines with a high-pressure fuel source (2) from which fuel is supplied to an injection opening (7) by means of a control valve (6) which can be actuated by a piezoelectric unit (9), the control valve (6) having a valve body (10), a valve member (8) having a valve head (12) disposed in the valve body (10) and movable axially with the valve head (12) between a first valve seat (13) and a second valve seat (14), which define a first valve chamber (15); a line (5) conveying fuel from the high-pressure fuel source (1) feeding into a second valve chamber (16), which is defined by the first valve seat (13) and a first guide (18) of the valve member (8) in the valve body (10); a line (22), which leads to the injection opening (7), and branching from the first valve chamber (15); a second guide (28) of the valve member (8) provided in a region of the valve member (8) adjacent to the second valve seat (14); and a respective leakage line (21, 30) on the side of each of the guides (18, 28) remote from the first valve chamber (15); the diameters of the valve seats (13, 14) and the guides (18, 28) are respectively being selected to be the same so that a force compensation is achieved in the control valve (6).

2. The fuel injection apparatus according to claim 1 wherein the piezoelectric unit (9) actuates the valve member (8) by means of a hydraulic chamber (19) that functions as a hydraulic transmission.

3. The fuel injection apparatus according to claim 1 wherein the second valve seat (14) and the second guide (28) of the valve member (8) are embodied on a sleeve (23) that is inserted into the valve body (10).

4. The fuel injection apparatus according to claim 2 wherein the second valve seat (14) and the second guide (28) of the valve member (8) are embodied on a sleeve (23) that is inserted into the valve body (10).

5. The fuel injection apparatus according to claim 3 wherein the sleeve (23) is secured in the valve body (10) by a fastening element, in particular a nut (26), on its end remote from the second valve seat (14).

6. The fuel injection apparatus according to claim 4 wherein the sleeve (23) is secured in the valve body (10) by a fastening element, in particular a nut (26), on its end remote from the second valve seat (14).

7. The fuel injection apparatus according to claim 1 further comprising a spring **(2*a*), and wherein, when in the non-actuated state, the valve member (8) is held against the first valve seat (13) by the spring (29)**.

8. The fuel injection apparatus according to claim 3 further comprising a spring **(2*a*), and wherein, when in the non-actuated state, the valve member (8) is held against the first valve seat (13) by the spring (29)**.

9. The fuel injection apparatus according to claim 5 further comprising a spring **(2*a*), and wherein, when in the non-actuated state, the valve member (8) is held against the first valve seat (13) by the spring (29)**.

10. The fuel injection apparatus according to claim 1 wherein in a region between the hydraulic chamber (14) and the first guide (18) oriented toward the piezoelectric unit (9), an annular chamber (20) around the valve member (8) is provided, from which one of the leakage lines (21) leads.

11. The fuel injection apparatus according to claim 3 wherein in a region between the hydraulic chamber (14) and the first guide (18) oriented toward the piezoelectric unit (9), an annular chamber (20) around the valve member (8) is provided, from which one of the leakage lines (21) leads.

12. The fuel injection apparatus according to claim 7 wherein in a region between the hydraulic chamber (14) and the first guide (18) oriented toward the piezoelectric unit (9), an annular chamber (20) around the valve member (8) is provided, from which one of the leakage lines (21) leads.

13. The fuel injection apparatus according to claim 1 wherein the leakage line (30) that is disposed on the side of the second guide (28) remote from the first valve chamber (15) is connected to the first valve chamber (15) by means of a line (31).

14. The fuel injection apparatus according to claim 10 wherein the leakage line (30) that is disposed on the side of the second guide (28) remote from the first valve chamber (15) is connected to the first valve chamber (15) by means of a line (31).

15. The fuel injection apparatus according to claim 13 wherein the line between the first valve chamber (15) and the leakage line (30) is at least partially embodied as a gap space (31) in the valve member (8) and/or in the sleeve (23).

16. The fuel injection apparatus according to claim 13 wherein the line between the first valve chamber (15) and the leakage line (30) is at least partially embodied as a gap space (31) in the valve member (8) and/or in the sleeve (23).

17. The fuel injection apparatus according to 15 wherein the gap space is comprised by an annular groove (32), which encompasses the valve member (8) in the sleeve (23), and a bevel (33) on the valve member (8), which connects the annular groove (32) to the end of the valve member (8) remote from the valve head (12).

18. The fuel injection apparatus according to claim 1 wherein the second guide (28) has a play that is greater than the play of the first guide (18) by a factor of 2 to 5, preferably by a factor of 2 to 3.

19. The fuel injection apparatus according to claim 3 wherein the valve body (10) is embodied of one piece, at least in the vicinity of the first guide (18), the first valve chamber (15), and a receptacle (24) for the sleeve (23), where the valve body (10) and the sleeve (23) are preferably each produced in one chucking operation.

20. The fuel injection apparatus according to claim 1 wherein the injection opening (7) is embodied as a nozzle holder device.

21. The fuel injection apparatus according to claim 1 wherein the high-pressure fuel source (1) is embodied as a common rail system.

* * * * *